US005303682A

United States Patent [19]

Donahue et al.

[11] Patent Number: 5,303,682

[45] Date of Patent: Apr. 19, 1994

[54] CYLINDER BORE LINER AND METHOD OF MAKING THE SAME

[75] Inventors: Raymond J. Donahue, Fond du Lac; Terrance M. Cleary, Allenton; William G. Hesterberg, Rosendale; Lawrence I. Toriello, Fond du Lac, all of Wis.

[73] Assignee: Brunswick Corporation, Skokie, Ill.

[21] Appl. No.: 778,012

[22] Filed: Oct. 17, 1991

[51] Int. Cl.[5] ..... F02F 7/00

[52] U.S. Cl. ..... 123/193.1; 164/114

[58] Field of Search ..... 123/193.1, 193.2, 195; 164/114, 97, 95, 34; 29/888.06, 888.061

[56] References Cited

U.S. PATENT DOCUMENTS

| | | | |
|---|---|---|---|
| 2,005,175 | 6/1935 | Adams | 164/114 |
| 3,333,579 | 8/1967 | Shockley et al. | 123/193.1 |
| 3,536,123 | 10/1970 | Izumi | 164/114 |
| 3,672,429 | 6/1972 | Lajoye | 164/114 |
| 4,124,056 | 11/1978 | Noble | 164/114 |
| 4,572,278 | 2/1986 | Sundberg | 164/114 |
| 4,603,666 | 8/1986 | Hesterberg et al. | 123/195 R |
| 4,821,694 | 4/1989 | Hesterberg et al. | 123/195 R |
| 4,875,517 | 10/1989 | Donahue et al. | 164/34 |
| 4,966,220 | 10/1990 | Hesterberg | 164/34 |
| 4,969,428 | 11/1990 | Donahue et al. | 123/195 R |
| 5,000,244 | 3/1991 | Osborne | 164/95 |

FOREIGN PATENT DOCUMENTS

| | | | |
|---|---|---|---|
| 0016662 | 1/1984 | Japan | 164/97 |

*Primary Examiner*—Noah P. Kamen

*Attorney, Agent, or Firm*—Andrus, Sceales, Starke & Sawall

[57] ABSTRACT

A hypereutectic aluminum-silicon alloy cylinder bore liner is produced by feeding the molten alloy into a metal mold having an inner shell sand cup, while rotating the mold at a speed in excess of 1,000 rpm, to cause the molten alloy to be thrown outwardly by centrifugal force to form a cylindrical liner. On solidification of the alloy, discrete silicon particles are precipitated and the use of the sand shell increases the fluid life of the alloy to enable the lighter weight silicon particles to migrate inwardly under the centrifugal force of rotation, to produce a solidified liner having a greater volume fraction of silicon particles in the inner portion of the liner where greater wear resistance is desired.

3 Claims, 1 Drawing Sheet

CENTRIFUGAL CAST LINER MAG. X 100

CENTRIFUGAL CAST LINER MAG. X 100

CYLINDER BORE LINER AND METHOD OF MAKING THE SAME

BACKGROUND OF THE INVENTION

It has long been recognized that the lighter weight and better heat transfer properties make aluminum alloys the logical choice as a material for internal combustion engine blocks and liners. However, most aluminum alloys lack wear resistance and it has been customary in the past to chromium-plate the cylinder bores in the engine block, or alternately, to apply cast iron liners to the cylinder bores. It is difficult to uniformly plate the cylinder bores and, as a result, plating is an expensive operation, and in the case of chromium plating, not environmentally friendly. The use of cast iron liners increases the overall cost of the engine block, as well as the weight of the engine.

Aluminum-silicon alloys containing less than about 11.6% by weight of silicon are referred to as hypoeutectic alloys, while alloys containing more than 11.6% silicon are referred to as hypereutectic alloys.

Hypoeutectic aluminum-silicon alloys have seen extensive use in the past. The unmodified alloys have a microstructure consisting of primary aluminum dendrites, with a eutectic composed of acicular silicon in an aluminum matrix. However, the hypoeutectic aluminum-silicon alloys lack wear resistance.

On the other hand, hypereutectic aluminum-silicon alloys, those containing more than about 11.6% silicon, contain primary silicon crystals which are precipitated as the alloy is cooled between the liquidus temperature and the eutectic temperature. Due to the large precipitated primary silicon crystals, these alloys have good wear resistant properties, and while alloys of this type have good fluidity, they have a relatively large or wide solidification range. The solidification range, which is a temperature range over which the alloy will solidify, is the range between the liquidus temperature and the invariant eutectic temperature. The wider the solidification range, the longer it will take for an alloy to solidify at a given rate of cooling. Thus, for casting purposes, a narrow solidification range is desired.

Typical wear resistant aluminum-silicon alloys are described in U.S. Pat. No. 4,603,665 and 4,969,428. U.S. Pat. No. 4,603,665 describes a hypereutectic aluminum-silicon casting alloy having particular use in casting engine blocks for marine engines. The alloy of that patent is composed by weight of 16% to 19% silicon, 0.4% to 0.7% magnesium, less than 0.37% copper, and the balance aluminum. The alloy has a narrow solidification range providing the alloy with excellent castability, and as the copper content is maintained at a minimum, the alloy has improved resistance to salt water corrosion.

U.S. Pat. No. 4,969,428 is directed to a hypereutectic aluminum-silicon alloy containing in excess of 20% by weight of silicon, and having an improved distribution of primary silicon in the microstructure. Due to the high silicon content of the alloy, along with the uniform distribution of primary silicon in the microstructure, improved wear resistance is achieved.

It has been recognized that as the silicon content of hypereutectic aluminum-silicon alloys is increased, the volume fraction of primary silicon particles in the microstructure will correspondingly increase, and this microstructure change will be associated with an increase in wear resistance for the alloy. However, it has also been recognized that as the silicon content of the hypereutectic aluminum-silicon alloy is increased, feeding problems, as well as floatation problems, can occur because the solidification range increases with an increased silicon content. As a result, the wear resistant properties achieved by an increased silicon content in hypereutectic aluminum-silicon alloys have been compromised, for the attainment of casting properties that allow sound castings to be produced.

Various casting techniques have been used in the past to cast alloys having a wide solidification range. One casting process, referred to as "squeeze" casting, applies pressure to the molten metal through use of a hydraulic ram, and acts to forge the "mushy" liquid and solid phases for casting soundness. However, the "squeeze" casting process is slow, and is restricted to simple shapes or configurations.

Another casting process utilized in the past for alloys having a relatively wide solidification range is centrifugal casting. Cast iron pipes and liners have been made in the past by centrifugal casting techniques, and the centrifugal casting process is capable of producing shrink-free iron pipe castings of high quality. Because the microstructure of cast iron consists of a continuous graphite phase intermingled within another continuous phase, i.e. the matrix ferrous phase, segregation of the graphite phase and the ferrous phase does not occur to any significant degree in the centrifugal casting process. As a result, centrifugal casting can produce sound iron castings by feeding the shrinkage without a modification of the distribution of the phase constituents.

SUMMARY OF THE INVENTION

The invention is directed to a centrifugally cast hypereutectic aluminum-silicon alloy having a higher volume fraction of primary silicon at the surface which is subjected to wear in service. The invention has particular application to the production of cylinder bore liners for engine blocks, in which the inner diameter surface of the liners, where the wear resistance is needed, has a higher volume fraction of primary silicon than the outer diameter surface of the liner.

To produce the liner, a molten aluminum-silicon alloy, containing more than about 12% by weight of silicon, is introduced into a rotating or spinning metal mold having an insulating inner sand shell or cup. The mold is rotated at a speed greater than 1,000 rpm, causing the molten alloy to be thrown outwardly by centrifugal force against the sand shell to produce the cylindrical liner. Solidification of the alloy causes precipitation of silicon particles and during rotation of the mold, the heavier weight liquid eutectic will be moved outwardly by centrifugal force, causing an inward migration of the silicon particles toward the inner surface of the liner. The insulating sand shell increases the fluid life of the molten alloy, retarding the solidification and enabling the discrete silicon particles to migrate toward the inner diameter surface of the liner, which is the surface of the liner which is subjected to wear during service.

Thus, the combination of the insulating sand shell, along with the centrifugal casting, produces a liner having an increased volume fraction of silicon particles in the inner portion of the wall thickness of the liner, while the outer portion of the wall thickness is substantially denuded of silicon particles. Therefore, a liner can be produced with a wear resistance comparable to that of a higher silicon alloy, yet utilizing a lower silicon alloy having better casting properties.

Other objects and advantages will appear in the course of the following description.

DESCRIPTION OF THE PREFERRED EMBODIMENT

Figure 1A:
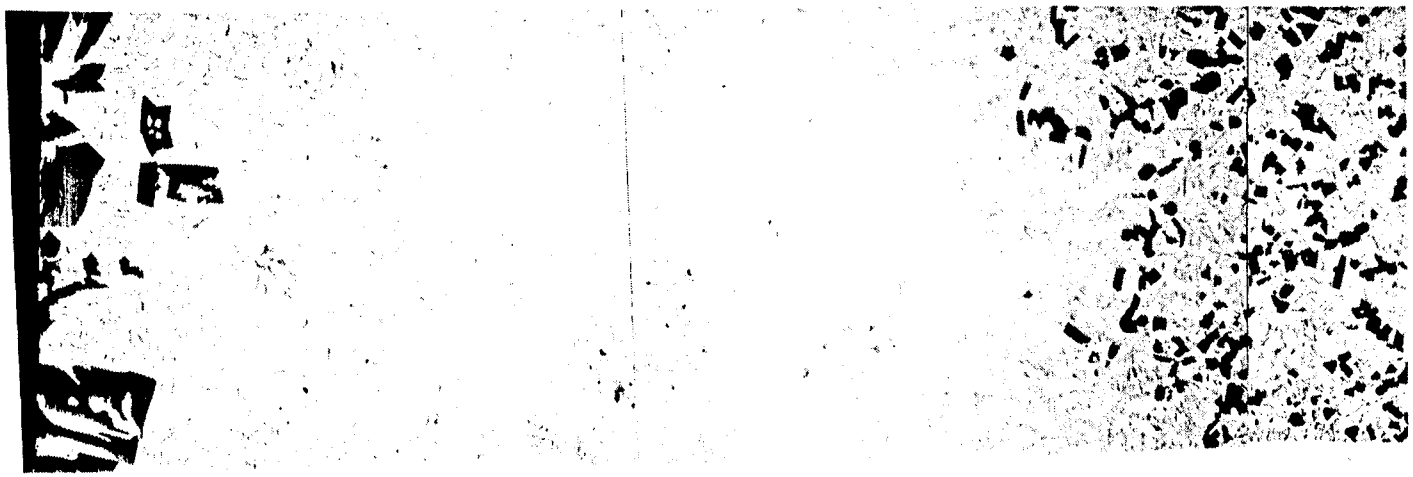
FIGS 1A and 1B are photomicrographs of the wall thickness of a cylinder bore liner produced in accordance with the invention.

The invention is directed to a centrifugally cast hypereutectic aluminum-silicon alloy having improved wear resistance, and more particularly to a cast hypereutectic aluminum-silicon alloy cylinder bore liner having a higher concentration of silicon particles adjacent the inner diameter surface which is subjected to wear during service.

The casting alloy is a hypereutectic aluminum silicon alloy containing more than 12% silicon, which is in the form of precipitated particles or crystals.

In general, the aluminum-silicon alloy contains by weight from, 12% to 30% silicon, 0.4% to 1.0% magnesium, less than 1.45% iron, less than 0.3% manganese, less than 0.37% copper, and the balance aluminum.

More particularly, the casting alloy can be composed of an aluminum-silicon alloy as described in U.S. Pat. No. 4,969,428, and having the following composition in weight percent:

| | |
|---|---|
| Silicon | 20.0%-30.0% |
| Magnesium | 0.4%-1.6% |
| Iron | Less than 1.45% |
| Manganese | Less than 0.30% |
| Copper | Less than 0.25% |
| Aluminum | Balance |

Alternately, the casting alloy can be a hypereutectic aluminum-silicon alloy as described in U.S. Pat. No. 4,821,694 having the following composition in weight percent:

| | |
|---|---|
| Silicon | 16.0%-19.0% |
| Magnesium | 0.4%-0.7% |
| Iron | Less than 1.4% |
| Manganese | Less than 0.3% |
| Copper | Less than 0.37% |
| Aluminum | Balance |

The silicon, being present as discrete precipitated particles or crystals, contributes to the wear resistance of the alloy.

The magnesium acts to strengthen the alloy through age hardening, while the iron and manganese tend to harden the alloy, decrease its ductility, increase its machinability, and aid in maintaining the mechanical properties of the alloy at elevated temperatures.

By minimizing the copper content, the corrosion resistance of the alloy to salt water environments is greatly improved.

The alloy can also contain small amounts, up to 0.2% each, of residual hardening elements, such as nickel, chromium, zinc or titanium.

The cylinder bore liners are produced using a centrifugal casting process. In the casting operation, an insulating shell sand cup is placed inside an outer mold formed of a metal, such as steel. The shell sand cup has a cylindrical wall with a thickness generally in the range of 0.125 to 0.250 inch, and is composed of sand with the sand particles bonded together by a conventional bonding agent, such as phenolic urethane. The shell has a coefficient of thermal conductivity of about 0.5 BTU/hr. ft.° F.

The hypereutectic aluminum-silicon alloy can be phosphorous-refined, although phosphorous refining is not essential, by phosphorous additions to the melt, as disclosed in U.S. Pat. No. 1,397,900. The addition of small amounts of phosphorous causes a precipitation of aluminum-phosphorous particles, which serve as an active nucleant for the primary silicon phase. Due to the phosphorous refinement, the primary silicon particles are of a smaller size and have a more uniform distribution.

The molten alloy at a pouring temperature, generally in the range of 1500° F. to 1550° F., is introduced into the inner shell sand cup while the mold is rotated at a speed generally in the range of about 1,000 to 5,000 rpm, and preferably about 2,800 rpm for a shell sand cup having a 3.5 inch diameter when producing a liner having a wall thickness of 0.187 inch.

The insulating shell reduces the rate of heat transfer from the molten alloy to the metal mold, thus increasing the fluid life of the molten metal and retarding solidification. As the molten alloy solidifies, primary silicon particles are precipitated, and as the precipitated particles have a lesser density than that of the eutectic liquid (the density of the silicon particles is approximately 2.3 $gm/cm^3$ as compared to a density of 2.6 $gm/cm^3$ for the eutectic), the eutectic liquid will be thrown outwardly by the centrifugal force causing an inward migration of the silicon particles toward the inner diameter surface of the liner, resulting in an increased volume fraction of primary silicon in the inner portion of the wall thickness of the liner. The increased concentration of silicon particles adjacent the inner diameter surface is at a location which is subjected to wear in service. Therefore, the liner has an increased wear resistance over that which would be expected for a given silicon content and the increased wear resistance is at the location which is exposed to wear during service.

Following the casting operation, the solidified cast liner can be removed from the mold either by hand or can be automatically ejected by conventional mechanical equipment.

The increased volume fraction of silicon particles in the inner portion of the cast part is achieved by mechanical force considerations when the system is acted upon by external centrifugal forces. Since the external force is readily controlled by the speed of rotation of the mold, the extent of silicon migration or "siliconizing" can be easily controlled in a production environment.

Using a metal mold without the sand shell cup will not achieve the desired migration of silicon particles, due to the fact that heat is transferred more rapidly from the molten alloy to the outer mold, causing early solidification of the alloy and preventing the migration of silicon particles under the G forces.

While the invention produces a microstructure modification in hypereutectic aluminum silicon alloys containing precipitated silicon particles, similar results are not achieved with hypoeutectic aluminum-silicon alloys containing less than 11.6% silicon. Hypoeutectic alloys form a continuous aluminum-dendrite network upon solidification before the eutectic transformation occurs.

As a result, the centrifugal casting process would only move and feed the interdendritic liquid through the tortuous aluminum-dendritic network and would hold that liquid in place until the eutectic temperature is reached, so that solidification would be completed without modifying the distribution of the phase constituents.

The drawing is a photomicrograph of a cylinder bore liner made in accordance with the method of the invention. The liner had a thickness of 0.187 inch and the photomicrograph shows the microstructure of the liner from the outer diameter surface to the inner diameter surface. FIG. 1B is a continuation of FIG. 1*a*, so that the two figures taken together show the entire wall thickness of the liner.

In producing the liner shown in the drawings, a hypereutectic aluminum-silicon casting alloy was utilized having the following composition in weight percent:

| | |
|---|---|
| Silicon | 19.0% |
| Magnesium | 0.40% |
| Iron | 0.18% |
| Manganese | 0.10% |
| Copper | 0.01% |
| Aluminum | Balance |

The molten alloy at a temperature of 1500° F. was introduced into a spinning metal mold having an inner sand shell with a thickness of 0.187 inch. The mold was rotated at a speed of 2,800 rpm.

After solidification of the molten alloy, the resulting cast liner was removed from the mold and the liner was sectioned to provide the photomicrographs as shown in the drawings.

Figure 1B:
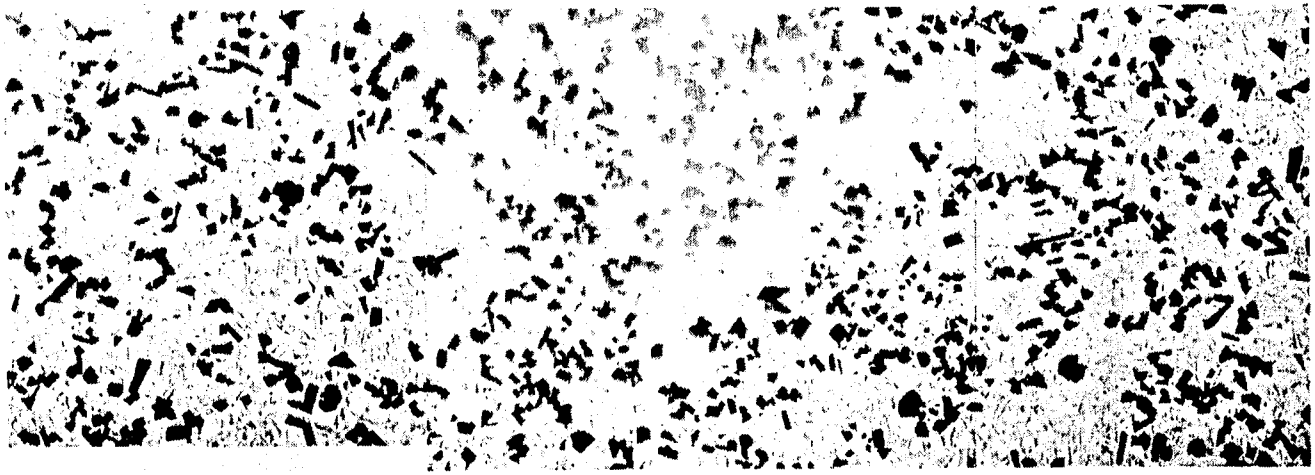

The photomicrograph, FIG. 1A, shows that the outer portion of the liner is substantially free or denuded of primary silicon and the silicon particles, which are the gray areas in the photomicrographs, have migrated toward the inner diameter surface (FIG. 1B), with the result that the inner portion of the wall thickness has an increased concentration of the silicon particles. It should be noted from FIG. 1A that a small concentration of silicon particles became attached to the outer diameter solidified skin of the casting, and therefore could not follow the mass movement of silicon particles toward the inner diameter surface.

The migration of the silicon particles toward the inner diameter surface of the liner is unique and unexpected and occurs during rotation of the mold because of the difference in density between the silicon particles and the liquid eutectic and insulating effect of the sand shell.

Through use of the invention, a liner is produced having a wear resistance along the inner diameter surface which is substantially greater than the wear resistance which would ordinarily be achieved by the silicon content of the alloy. This enables hypereutectic aluminum-silicon alloys having a lesser silicon content and having better casting properties to be utilized in forming the wear resistant cylinder bore liners.

Various modes of carrying out the invention are contemplated as being within the scope of the following claims particularly pointing out and distinctly claiming the subject matter which is regarded as the invention.

We claim:

1. A cylinder bore liner for an engine block, comprising a cylindrical member to be disposed in a cylinder bore and composed of a hypereutectic aluminum-silicon alloy containing more than 12% silicon and containing precipitated particles of silicon, a portion of the radial wall thickness of said cylindrical member located adjacent the inner diameter surface having a higher volume fraction of silicon particles than the portion of said wall thickness located adjacent the outer diameter surface of said cylindrical member, the portion of the wall thickness adjacent the outer diameter surface being substantially free of silicon particles.

2. The liner of claim 1, wherein said alloy contains by weight from 12% to 30% silicon, 0.4% to 1.0% magnesium, less than 1.4% iron, less than 0.3% manganese, less than 0.37% copper, and the balance aluminum.

3. An engine block assembly, comprising an engine block having a plurality of cylinder bores, a liner disposed in each cylinder bore and having a radial thickness in the range of 0.125 to 0.250 inch, each liner composed of a hypereutectic aluminum-silicon alloy containing more than 12% silicon and containing precipitated particles of silicon, a portion of the radial wall thickness of said liner located adjacent the inner diameter surface having a higher volume fraction of silicon particles than the portion of said wall thickness located adjacent the outer diameter surface of said liner, the portion of the wall thickness adjacent the outer diameter surface being substantially free of silicon particles.

* * * * *